United States Patent [19]

Buzzi et al.

[11] Patent Number: 4,555,835

[45] Date of Patent: Dec. 3, 1985

[54] PROCESS FOR PRODUCING PROPELLERS

[75] Inventors: Fabio Buzzi, Annone Brianza; Emilio Riganti, Solbiate Arno, both of Italy

[73] Assignee: Innocente Riganti Officine Meccaniche S.p.A., Solbiate Arno, Italy

[21] Appl. No.: 564,510

[22] Filed: Dec. 22, 1983

[30] Foreign Application Priority Data

Jan. 7, 1983 [IT] Italy ..... 19028 A/83

[51] Int. Cl.[4] ..... B21K 3/00; B23P 15/00

[52] U.S. Cl. ..... 29/156.8 R; 29/156.8 B; 29/156.8 P; 29/557; 29/DIG. 18; 29/DIG. 26; 29/DIG. 48; 228/165; 416/213 R; 440/49

[58] Field of Search ..... 29/156.8 R, 156.8 B, 29/156.8 P, 527.1, 557, DIG. 10, DIG. 18, DIG. 26, DIG. 48; 228/165; 416/213 A, 213 R, 176; 415/71; 440/49

[56] References Cited

U.S. PATENT DOCUMENTS 1,882,164 10/1932 Ross ..... 29/156.8 R
2,065,154 12/1936 Rayniak ..... 416/213 A
2,450,493 10/1948 Strub ..... 416/213 R X
4,058,880 11/1977 Hughey ..... 29/156.8 P

*Primary Examiner*—Howard N. Goldberg
*Assistant Examiner*—Ronald S. Wallace
*Attorney, Agent, or Firm*—Peter K. Kontler

[57] ABSTRACT

A method is provided for the fabrication of a steel propeller which is designed to have a final shape and size consistent with a conventional propeller design. The resultant formed propeller includes n individual blades, each having boss segments. When the boss segments of the individual blades are joined together they form a propeller having a center boss portion. A center aperture may thereupon be drilled or bored in the boss for mounting the propeller on the shaft of a marine engine. The propeller is formed, in accordance with the method of the present invention, by individually press-forging n steel blanks into individual blade portions which include boss segments. The press-forged blades are then ground with their lateral surfaces beveled to permit them to be welded together into a whole propeller. The center aperture is then formed and the propeller finally heat treated and finally ground.

10 Claims, 7 Drawing Figures

PROCESS FOR PRODUCING PROPELLERS

BACKGROUND OF THE INVENTION

The present invention relates generally to a process for producing a propeller and, more particularly, to such a process for producing a steel propeller adapted to be mounted on the propeller shaft of a marine engine for use on a boat.

Metal propellers currently being used for such purposes are generally fabricated using a one-piece casting or precision casting process, i.e., by introducing a suitable metal alloy, such as, for example, bronze and steel, into a casting mold and then casting the propeller. Other processes may be used for fabricating small propellers for boats in which the blades are made separately from the hub or boss. In such propellers, the blades have tangential projections at the end of the coupling to the boss and the boss has grooves made to receive the tangential projections. In such a construction, the boss and blades form a single piece when the tangential projections on the blades are made to slide into the grooves.

In still another process for manufacturing small two-bladed steel boat propellers, a parallelepiped steel ingot is forged or otherwise molded to form a propeller.

The aforementioned processes each possess certain inherent disadvantages, all of which are overcome by the present process. Propellers which are manufactured by such casting processes usually have relatively thick profiles which cause them to be very inefficient in actual operation. such cast propellers inherently have thick profiles. Due to the mechanical resistance of the materials used in casting such propellers, it is generally impossible to reduce the thickness and therefore their profiles beyond a certain point. A disadvantage of the second mentioned process, i.e., where the blades are made independently of the boss, constructional requirements limit the cross section of the coupling between the blades and the boss resulting in a rather weak propeller.

SUMMARY AND OBJECTS OF THE PRESENT INVENTION

A primary object of the present invention is to provide a process for fabricating propeller blades which have a particularly thin profile and which possess excellent mechanical strength characteristics.

Another object of the present invention is to provide such a process wherein the blades are press-forged from a blank of steel.

Still another object of the present invention is to provide such a process which can be used in fabricating high-efficiency propeller blades.

The process of the present invention, in brief summary, comprises designing a propeller of generally conventional design which has virtually all of the mechanical characteristics which a piece of molded steel can possess. The drawing of the part comprises a blade of the propeller and a corresponding segment of the boss whose vertex angle is substantially equal to 360°/n, where n is the number of blades of the propeller. A forging mold and a complimentary dolly are then constructed which are of suitable size and design for forging a piece of steel corresponding to the designed part. Steel blanks are then press-forged in the mold and dolly using suitable press means with each steel blank generally corresponding to the designed part. The press forged steel blanks are then roughed out or rough ground to form the desired shape and then the flat lateral surfaces of the segments of the boss in each of the press-forged steel parts are prepared so that their flat lateral surfaces generally conform to the surfaces of the designed part with a bevel formed in the said lateral flat surfaces. The bevel which is formed is at least as long as the thickness of the circular crown of the designed boss.

The parts are then assembled and fitted together in such a manner that the parts are positioned with their vertices converging in the center of the cylinder comprising the boss. The n segments of the boss are then welded to adjacent boss segments by the formation of a weld bead in channels created by two of the said adjacent bevels. The center aperture is then bored or drilled in accordance with the desired propeller design. One or more lots are then formed in the surface surrounding the center aperature to accommodate one or more raised locking elements on the propeller shaft so as to align the propeller with and affix the propeller to the propeller shaft. Finishing of the propeller comprises levelling off of the weld bead flush with the circular profile of the boss. The propeller is then heat treated to a desired hardness and then finely ground.

The novel features which are considered characteristic of the invention are set forth in particular in the appended claims. The improved process itself, both as to its mode of operation and operating parameters as well as to its additional features and advantages thereof, will be best understood upon review of the following detailed description of certain specific embodiments of the invention with particular reference to the accompanying drawings.

DETAILED DESCRIPTION OF THE INVENTION

In accordance with the process of the present invention, the initial design of the propeller to be fabricated is arrived at using conventional calculations allowing for the mechanical characteristics possessed by the particular type of steel used for the propeller made by press-forging and given the optimum type of heat treatment selected.

Figure 1:
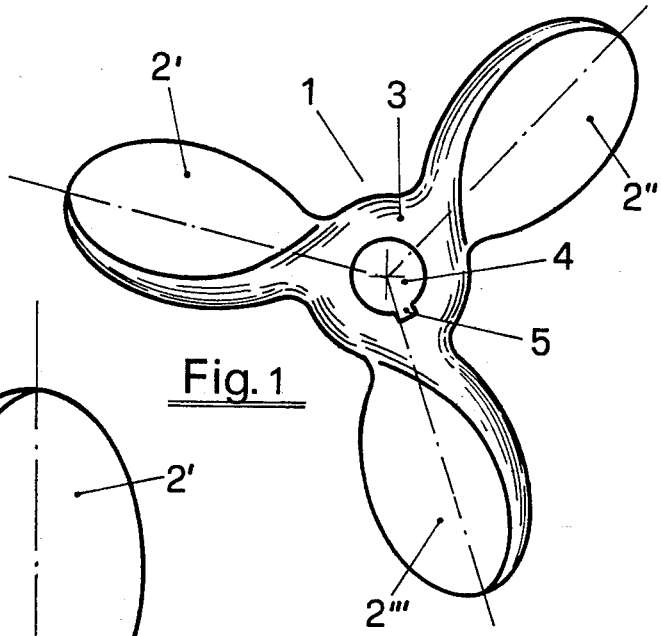
FIG. 1 is a front-elevational view of a three-bladed steel propeller adapted to be mounted on the propeller shaft of a marine engine which is fabricated using the process of the present invention.

A particular boat propeller which may be manufactured in accordance with the process of the present invention is illustrated in FIG. 1. The propeller, which is referred to generally by reference numeral 1, includes a plurality of blades 2 which are interconnected by a boss or hub 3. In the preferred embodiment illustrated in FIG. 1, three blades 2', 2'', and 2''' are provided, each of substantially identical construction. A center aperture or hole 4 is provided in the boss 3 to permit mounting of the propeller 1 on the shaft of a marine engine (not shown). Aperture 4 includes a seat 5 as a slot which is adapted to align itself with a raised locking and alignment element on the engine shaft (not shown) to permit proper alignment and locking of the propeller 1 on the shaft.

Figure 2:
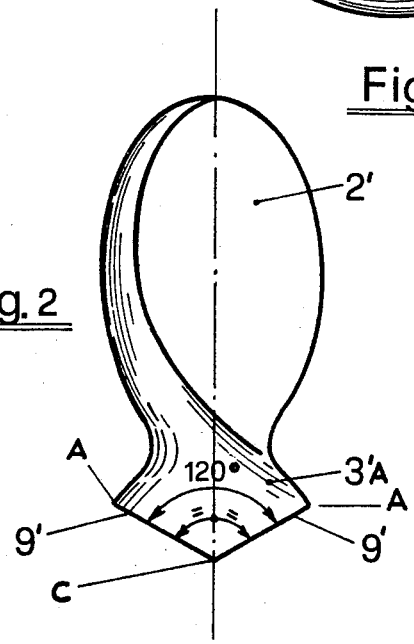
FIG. 2 is a partial front elevational view of one of such blades and a corresponding segment of a boss of a propeller which substantially conforms to a drawing of the part itelf and which is the same as a press-forged and roughed part made from the blank illustrated in FIG. 4.

In accordance with the process of the present invention, the specific desired configuration of the propeller 1 is initially created to account for material type and strength as well as for engine size, power and type of boat to be powered. The individual blades 2 are each to be press-forged separately with their corresponding segments of the center boss 3. Such an individual blade 2' is illustrated in front elevational view in FIG. 2 with its corresponding segment of the boss 3'A. As illustrated in FIG. 2, the vertex angle C of the individual boss segment 3'A is established at 120°. It will, of course, be appreciated that this vertex angle of the individual boss segment 3'A is a function of the actual number of the individual blades 2 selected and will increase or decrease directly with the number of separate or individual blades 2 chosen. The specific vertex angle selected is derived by the formula 360°/n, where n represents the actual number of blades 3 on the propeller 1.

Figure 3:
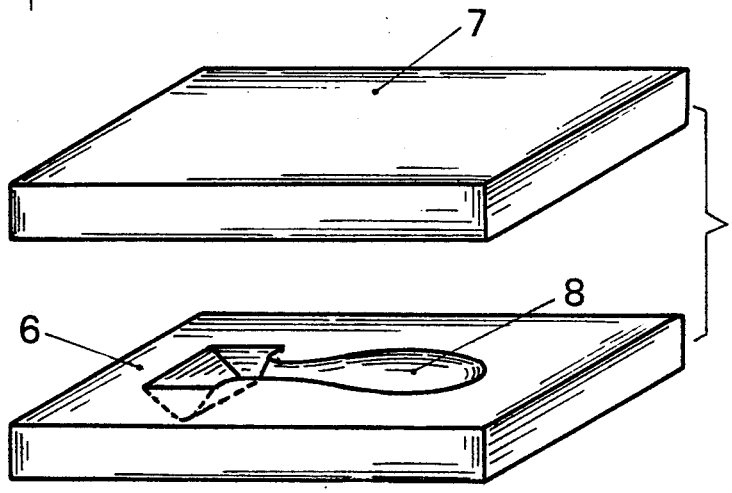
FIG. 3 is a perspective view of a mold and dolly suitable for press-forging the blank to form the part shown in FIG. 2.

A press-forging mold and dolly are then each designed and fabricated to accommodate the designed blade 2' and individual boss segment 3'A. Such press-forging mold 6 and overlay dolly 7 are illustrated in FIG. 3. As shown, the press-forging mold 6 includes a recessed impression portion 8 which is configured and sized to receive a malleable material for press-forging the desired propeller blade 2. A complementary impression portion may also be included in the overlay dolly 7. The press-forging mold 6 and dolly 7 are preferably fabricated from steel with the impression portions being formed in each of them by electrolytic corrosion processes. When the press-forging mold 6 and the dolly 7 are placed together, the shape and configuation of the cavity formed by the impression portions is that of a blank consisting of a blade 2'G and a corresponding boss segment 3'AG a shown in FIG. 4.

Figure 4:
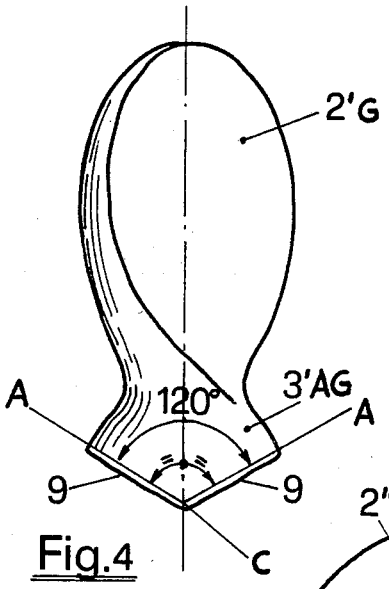
FIG. 4 is a front elevational view of the blank of a blade with corresponding boss segments as it is removed from the mold.

In order to fabricate the desired propeller 1 in accordance with the teachings of the present invention, with the press-forging mold 6 and the dolly 7 mounted in a suitable press, the desired number n of blanks necessary to form the desired propeller 1 are press-forged to create n identical blades 2 and boss segments 3A as illustrated in front elevational view in FIG. 4. In a preferred embodiment, n=3 so as to form a propeller having 3 blades 2', 2'' and 2'''. As illustrated in FIG. 4, it will be seen that the two lateral faces or surfaces 9 of the blanked boss segments 3'AG project beyond the two faces C-A which conform to the part drawing shown in FIG. 2.

After press-forging of the three identical blanked propeller blades 2, they are then rough ground and their lateral surfaces 9 are so prepared that the three parts substantially conform to the designed blade and boss segment of FIG. 2.

Figure 6:
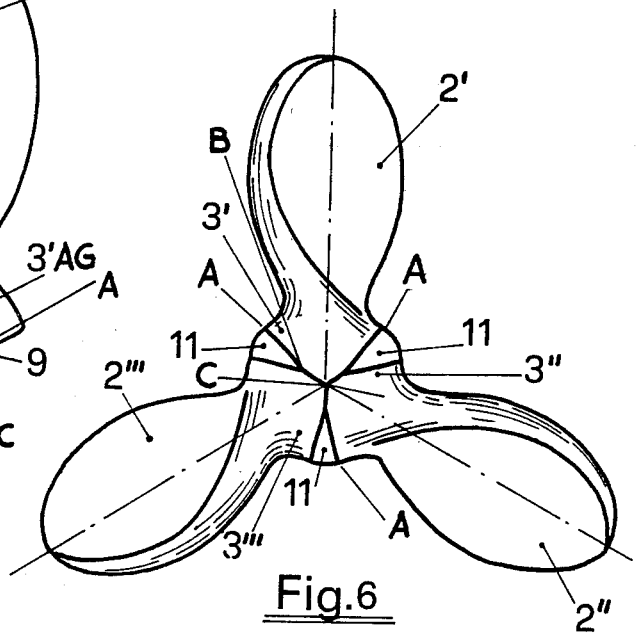
FIG. 6 is a front elevational view of the three parts assembled and fitted together.
Figure 5:
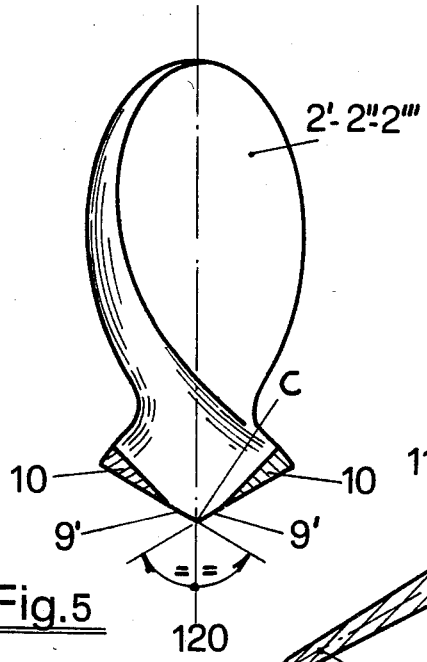
FIG. 5 is a front elevational view of the part illustrated in FIG. 4 after it is roughed out, the flat surfaces of the boss segments are prepared and it is prepared for welding together with two other identical pieces.

As illustrated in FIG. 5, the lateral surfaces 9' are ground at a sufficient angle or bevel over a length at least equal to the thickness of the circular cross of the boss of the designed and drawn propeller 1 to create a space sufficient to accommodate a welding material which must be used to join the individual blades 2 together to form the resultant propeller 1 as shown in FIG. 6. As shown in FIG. 6, the three boss segments 3', 3'', and 3''' are welded together to form the final propeller 1 by a suitable welding process using suitable welding materials to form three weld beads 11 at the interfaces of the respective segments. Weld beads are illustrated in both FIGS. 6 and 7.

Upon formation of the desired propeller 1, the center aperture 4 is then drilled or bored out. The actual selected diameter of the aperture 4 is slightly smaller than the diameter of the designed part of FIG. 1. A keyway broach is then used to cut the seat 5 relative to the aperture 4 to permit the propeller 1 to become properly aligned with and locked to the propeller shaft of the marine engine with which it is adapted to be used.

The external rounded surfaces of the weld beads 11 are then milled down to make them flush with the outer profile of the boss 3. The actual depth A-B of the weld beads seen in FIG. 6 is such that, when forming the center aperture 4, the internal extremities of the beads 11 are cut away so that the entire thickness of the circular crown of the boss 3 will consist of parts which are joined together.

Figure 7:
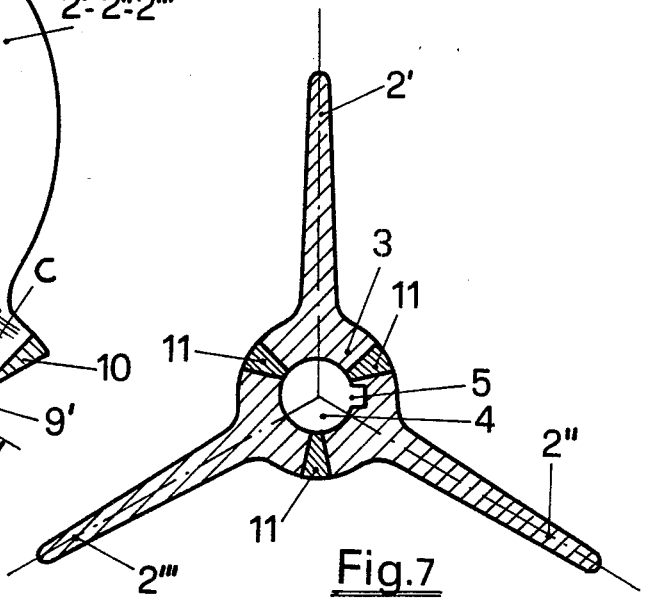
FIG. 7 is a cross-sectional view of the part taken in a plane normal to the axis of rotation of the finished propeller.

FIG. 7 illustrates in cross-section the propeller constructed in accordance with the process of the present invention, namely that of a propeller which conforms to the desired design of FIG. 1 and which includes three blades 2', 2'' and 2''', a boss 3, and a center aperture 4 hving a seat 5 to accommodate a key (not shown) on the shaft of a propeller.

The operations described above are thereupon followed by a suitable conventional heat treatment operation to achieve a desired hardness level and by final grinding of the center aperture to reach the ultimate diameter.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims which are appended hereto.

Wherefore we claim:

1. A method of fabricating a marine engine propeller of a desired shape and size and with n individual propeller blades each integral with a central hub having a circular crown and an aperture adapted to permit attachment to the propeller shaft of a marine engine, said propeller blades each having a hub segment the vertex angle of which between lateral edges is 360°/n, comprising the steps of press-forging each of said n blades from blanks within a forging press comprising a press-forging mold having at least one recessed impression portion which substantially conforms to the size and shape of the desired blades;

beveling the surfaces of said lateral edges over a length at least equal to the thickness of the circular crown of the hub of the propeller;

arranging said blades in radial fashion with a beveled edge surface of each blade substantially abutting the beveled edge of each adjacent blade;

welding each of the n hub segments to adjacent segments by applying a welding material into the channels formed by the adjacent beveled lateral edge surfaces to form a one piece propeller having a central hub; and forming a center aperture in the hub of said propeller.

2. The method of claim 1 further including the step of rough grinding the press-forged blades.

3. The method of claim 1 further including the step of forming in the center aperture a seat one or more locking elements on a propeller shaft to align and lock said propeller to said shaft.

4. The method of claim 1 further including the step of grinding the weld beads on the propeller flush with the circular crown of the hub.

5. The method of claim 1 further including the step of heat treating the forged propeller to a desired hardness.

6. The method of claim 1 wherein said press-forging mold is a steel mold.

7. The method of claim 1 wherein said blanks to be press-forged are steel blanks.

8. The method of claim 1 wherein n equals 3.

9. The method of claim 1 wherein said center aperture is formed by drilling a hole in the center of said propeller, the diameter of said drilled hole being slightly less than the ultimate desired diameter of the center aperture.

10. The method of claim 9 further including the step of finish grinding the hole drilled in the propeller to a final diameter of the center aperture.

* * * * *